US009770392B2

(12) United States Patent
Wesley

(10) Patent No.: US 9,770,392 B2
(45) Date of Patent: Sep. 26, 2017

(54) DUAL COMPARTMENT BOTTLE WITH ACCESS CAP

(71) Applicant: Antonio Jarvis Wesley, Las Vegas, NV (US)

(72) Inventor: Antonio Jarvis Wesley, Las Vegas, NV (US)

( * ) Notice: Subject to any disclaimer, the term of this patent is extended or adjusted under 35 U.S.C. 154(b) by 408 days.

(21) Appl. No.: 14/292,769

(22) Filed: May 30, 2014

(65) Prior Publication Data

US 2015/0342831 A1 Dec. 3, 2015

(51) Int. Cl.
*B65D 51/18* (2006.01)
*A61J 9/00* (2006.01)
*A61J 9/06* (2006.01)

(52) U.S. Cl.
CPC ..... *A61J 9/00* (2013.01); *A61J 9/008* (2013.01); *A61J 9/0623* (2015.05)

(58) Field of Classification Search
CPC ..... A61J 9/00; A61J 9/001; A47G 19/2272; B65D 2543/00231; B65D 2543/0024; B65D 2543/0025
USPC ..... 215/11.1, 11.4; 220/254.3, 254.4, 254.6, 220/713; 222/138, 139
See application file for complete search history.

(56) References Cited

U.S. PATENT DOCUMENTS 4,856,995 A * 8/1989 Wagner ..... A61J 9/001 215/11.1
5,593,052 A * 1/1997 McGee ..... A61J 9/00 215/11.1
5,758,786 A * 6/1998 John ..... A61J 11/045 215/11.1
5,938,053 A * 8/1999 Verbovszky ..... A47G 19/2272 215/11.1
8,328,044 B1 * 12/2012 Iskandar ..... A47G 19/2272 220/254.3
9,029,738 B2 * 5/2015 Redl ..... A47J 41/0038 219/387
2005/0056614 A1 * 3/2005 Morano ..... A47G 19/2272 215/396
2015/0375910 A1 * 12/2015 Cohen Bissu ..... B65D 47/265 53/484

* cited by examiner

*Primary Examiner* — William Gilbert

(57) ABSTRACT

A container with a divider designed to hold two liquids separately inside. A cap on the container includes a twist mechanism that permits separate access to one side or the other side of the container without mixing the two materials within the container. The container can have installed infant holding handles. These handles are used to equal out the bottle weight, and are small enough for an infant to grab and hold. Instead of making two bottles to hold each liquid, one bottle can support two separate liquids.

1 Claim, 3 Drawing Sheets

THE COMPLETE BOTTLE

THE TOP
(1)
(2)
(3)
(3)
(5)
(5)
(5)

(1)
(2)
(3)
(3)
(2)
(1)

(4)
(1)
(2)
(1)
(3)

(2)
(1)
(3)
(3)
(2)
(1)

(7)
(8)

DUAL COMPARTMENT BOTTLE WITH ACCESS CAP

Figure 1:
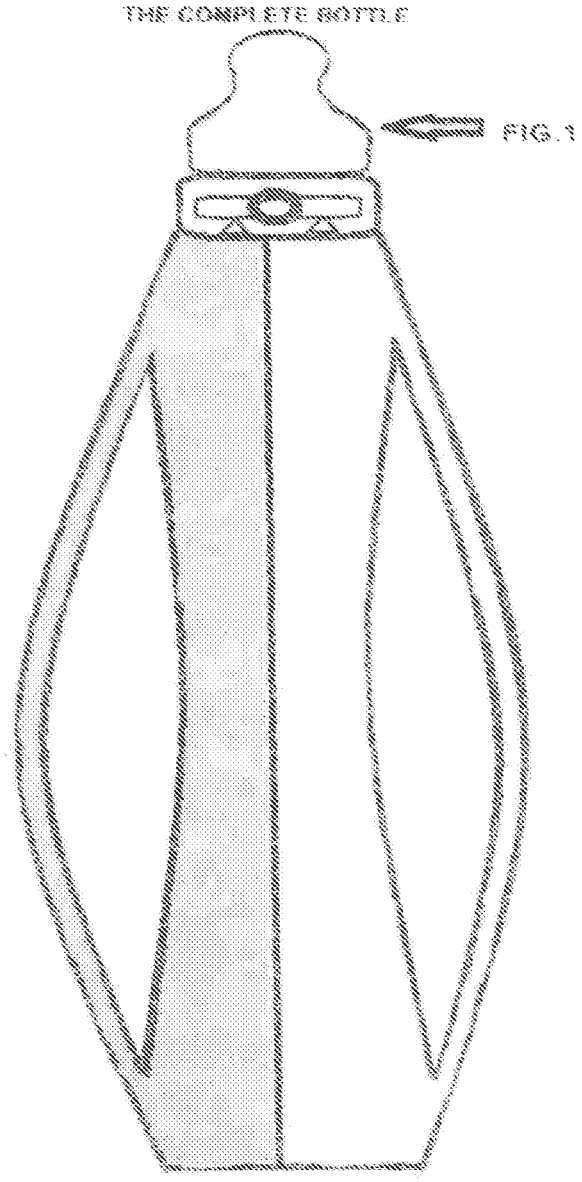
FIG. 1. This is a standard side view of my invention for a two sided baby bottle in its entirety.
Figures 2, 3, 4, 5:
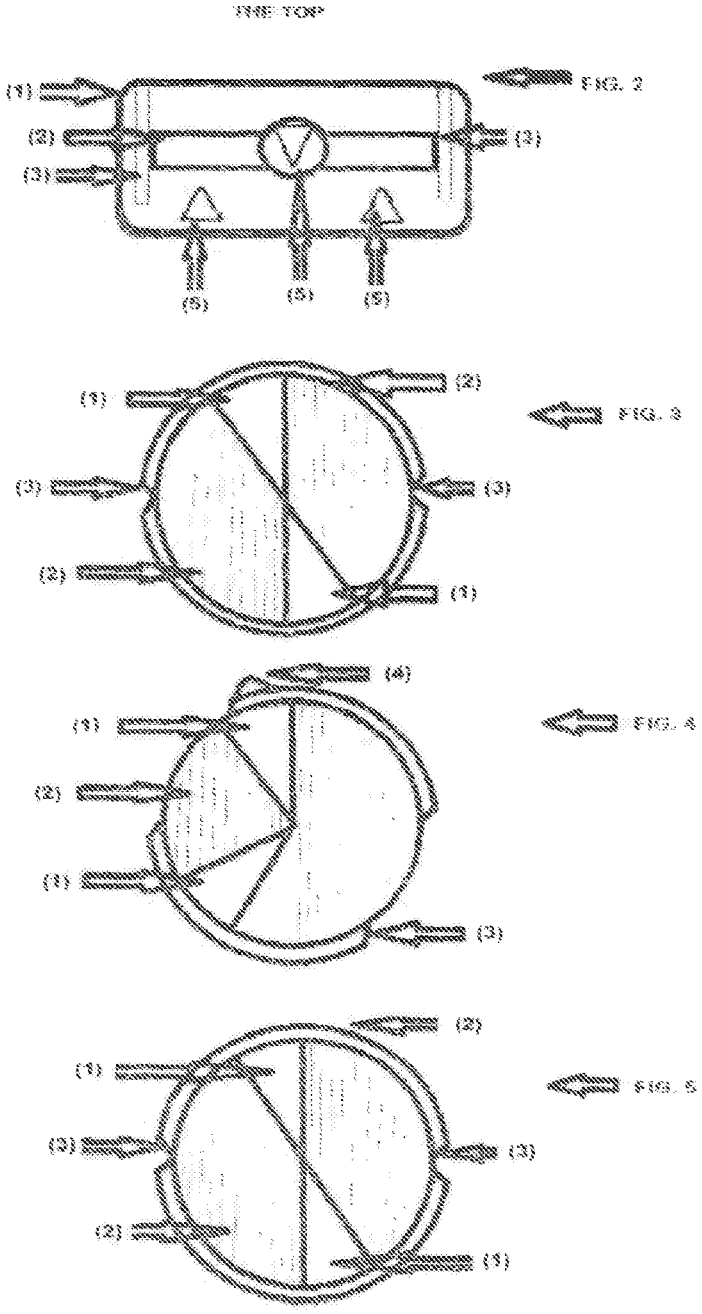
FIG. 2. This is a standard side view illustration of the top cap portion of the container, of the invention shown in FIG. 1.
FIG. 3. This is a standard over the top view, of the first disk found inside the top portion of this cap as shown in FIG. 2.
FIG. 4. This is a standard over the top view of the second disk found inside the top portion of this cap as shown in FIG. 2.
FIG. 5. This is a standard over the top view of the third and final disk found inside the top portion of this cap shown in FIG. 2.

DETAILED DESCRIPTION (Reference FIGS. 1-3)

Figure 6:
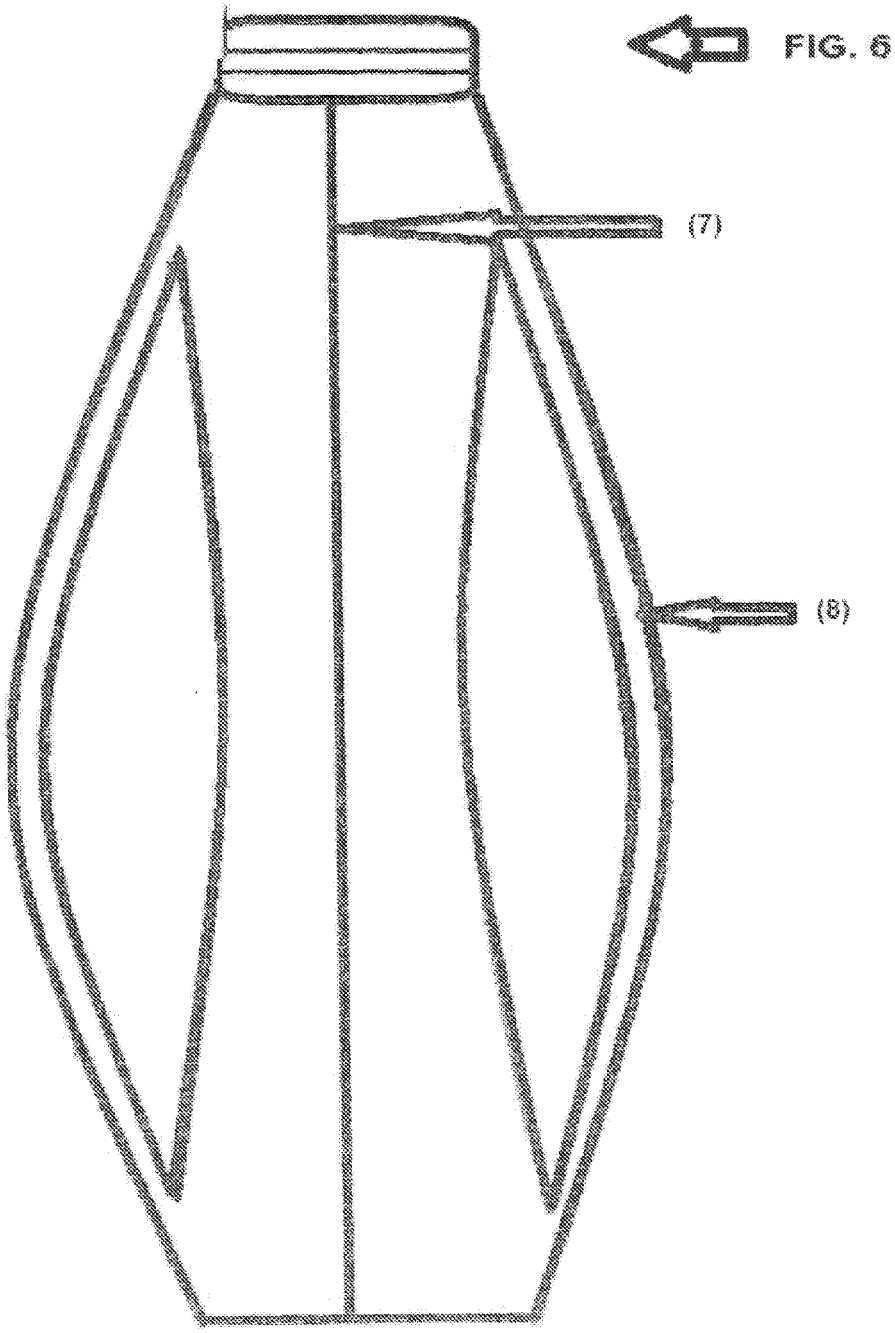
FIG. 6. This is a standard side view of the bottle or container, that is present in FIG. 1.

This one bottle that contains two individual sides, allowing two fluids to be held or dispensed threw the same top, or spout without any leakage or mixture. This sleek baby bottle design, Has two thin hollow handles running from the top, to the bottom of each side of the bottle FIG. 6 (8). It also has a thin plastic divider inside the bottle to separate the two liquids. Top carries a Three part mechanism, FIG. 6 (7). This top has two pins centered across from each other to hold the washer disks in a stable position (3). There is also two arrows that indicate the position of the liquid flow, (5). The first pc. The first piece, FIG. 3. hard circular plastic disk with two triangular shaped holes, cut directly across from one another, (1). also two pin slot holes, (2) these slots hold and secure FIG. 3. in position, allowing the liquids to flow free. The next piece FIG. 4. This is another hard circular plastic disk, with two triangular shaped holes (1). These holes are offset with sliding slot pin holes, (4), and a small plastic lever (3), the lever is used to slide this plastic disk back and forth to choose the preferred liquid, while closing off the second hole to prevent any mixture or leakage. This last piece is also another hard plastic circular disk, FIG. 5 with two triangular shaped holes cut directly across from one another, (1) with two pin slot holes, (3) used to hold this plastic disk in position. When all the parts are secure inside the top, FIG. 2 they become a leak proof mechanism, with a moving center disk to give you a choice to choose your preferred liquid, with no risk of leaks or mixing liquids.

What I claim as my new invention is:

1. A container and a cap comprising;

said container having an opening at a first end, and a divider dividing said container into a first and a second separate sub-container portions;

said cap further comprising;

a top portion configured to attach to said first end to create a connected condition, a first disk portion being substantially circular and having a first opening and a second opening diametrically opposite said first opening such that said first opening permits access to said first sub-container portion and said second opening permits access to said second sub-container portion during said connected condition, a second disk portion being substantially circular and having a third opening and a fourth opening diametrically opposite said third opening, said third portion being above said second portion such that said third opening is in substantial alignment with said first opening and said fourth opening is in substantial alignment with said second opening, a third disk portion between said first disk portion and said second disk portion and being substantially circular and having a perimeter and having a fifth opening and a sixth opening, said third disk portion being able to rotate relative to said first disk portion and said second disk portion from a first position to a second position, a first pin and a second pin configured to connect said top portion, said first disk portion, said second disk portion and said third disk portion, whereby said first position substantially aligns said fifth opening with said first opening and said third opening but does not align said sixth opening with said second opening and said fourth opening, and said second position substantially aligns said sixth opening with said second opening and said fourth opening but does not align said fifth opening with said first opening and said third opening, said third disk portion further comprising a lever at the perimeter facilitate rotation of said third disk portion and to indicate if said third disk portion is in said first position or said second position.

* * * * *